US007846363B2

(12) United States Patent
Tam et al.

(10) Patent No.: US 7,846,363 B2
(45) Date of Patent: Dec. 7, 2010

(54) PROCESS FOR THE PREPARATION OF UHMW MULTI-FILAMENT POLY(ALPHA-OLEFIN) YARNS

(75) Inventors: Thomas Y-T. Tam, Richmond, VA (US); Qiang Zhou, Chesterfield, VA (US); John A. Young, Midlothian, VA (US); Charles R. Arnett, Richmond, VA (US); John E. Hermes, Colonial Heights, VA (US)

(73) Assignee: Honeywell International Inc., Morristown, NJ (US)

( * ) Notice: Subject to any disclaimer, the term of this patent is extended or adjusted under 35 U.S.C. 154(b) by 217 days.

(21) Appl. No.: 11/811,569

(22) Filed: Jun. 8, 2007

(65) Prior Publication Data

US 2008/0048355 A1 Feb. 28, 2008

Related U.S. Application Data

(60) Provisional application No. 60/839,594, filed on Aug. 23, 2006.

(51) Int. Cl.
*B29C 47/88* (2006.01)

(52) U.S. Cl. ..... 264/211.15; 264/211.18; 264/205; 264/178 R

(58) Field of Classification Search ..... 264/178 R, 264/205, 211.15, 211.18
See application file for complete search history.

(56) References Cited

U.S. PATENT DOCUMENTS 4,374,960 A * 2/1983 Rothwell et al. ..... 525/436
4,411,854 A 10/1983 Maurer et al. ..... 264/205.12
4,413,110 A * 11/1983 Kavesh et al. ..... 526/348.1
4,422,993 A 12/1983 Smith et al. ..... 264/210.8
4,430,383 A 2/1984 Smith et al. ..... 428/364
4,436,689 A 3/1984 Smith et al. ..... 264/204
4,536,536 A 8/1985 Kavesh et al. ..... 524/462
4,545,950 A 10/1985 Motooka et al. ..... 264/210.6
4,551,296 A * 11/1985 Kavesh et al. ..... 264/203
4,612,148 A 9/1986 Motooka et al. ..... 264/49
4,617,233 A 10/1986 Ohta et al. ..... 428/364
4,663,101 A 5/1987 Kavesh et al. ..... 264/178 F (Continued)

FOREIGN PATENT DOCUMENTS

EP 0 077590 4/1983

(Continued)

OTHER PUBLICATIONS

Smith et al., "Ultrahigh-Strength Polyethylene Filaments by Solution Spinning and Hot Drawing", *Poly. Bull.*, 1, 733-736 (1979).

(Continued)

*Primary Examiner*—Joseph S Del Sole
*Assistant Examiner*—David N Brown, II

(57) ABSTRACT

A process for preparing ultra-high molecular weight poly (alpha-olefin) (UHMWPO) multi-filament yarns having improved tensile properties at higher productivity. The process includes drawing a solution yarn, then drawing a gel yarn and then drawing a dry yarn continuously in sequence to form a partially oriented yarn, winding up the partially oriented yarn, unrolling the yarn, drawing the partially oriented yarn to form a highly oriented yarn, cooling the highly oriented yarn under tension and winding up the highly oriented yarn.

21 Claims, 3 Drawing Sheets

U.S. PATENT DOCUMENTS

| | | | | |
|---|---|---|---|---|
| 5,032,338 | A | 7/1991 | Weedon et al. | 264/203 |
| 5,246,657 | A | 9/1993 | Yagi et al. | 264/210.6 |
| 5,286,435 | A | 2/1994 | Slutsker et al. | 264/205 |
| 5,342,567 | A | 8/1994 | Chen et al. | |
| 5,547,626 | A | 8/1996 | Ohta et al. | 264/203 |
| 5,578,374 | A | 11/1996 | Dunbar et al. | 428/364 |
| 5,736,244 | A | 4/1998 | Kavesh et al. | 428/364 |
| 5,741,451 | A * | 4/1998 | Dunbar et al. | 264/103 |
| 5,958,582 | A | 9/1999 | Dunbar et al. | 428/361 |
| 6,037,056 | A * | 3/2000 | Macdonald et al. | 428/369 |
| 6,448,359 | B1 | 9/2002 | Kavesh | 526/352 |
| 6,969,533 | B1 | 11/2005 | Martin et al. | 424/728 |
| 2004/0052883 | A1 * | 3/2004 | McConnell | 425/72.2 |
| 2005/0093200 | A1 | 5/2005 | Tam et al. | 264/211.14 |

FOREIGN PATENT DOCUMENTS

| | | |
|---|---|---|
| EP | 0320188 | 6/1989 |
| GB | 2042414 A | 9/1980 |
| GB | 2051667 B | 1/1981 |
| JP | A-60/52647 | 8/1983 |
| JP | KOKAI 238416-1995 | 9/1995 |

OTHER PUBLICATIONS

Smith et al., "Ultrahigh Strength Polyethylene Filaments by Solution Spinning/Drawing. 2 Influence of Solvent on the Drawability", *Makromol Chem*., 180, 2983-2986 (1979).

Smith et al., "Ultrahigh Strength Polyethylene Filaments by Solution Spinning/Drawing" *J. Mat. Sci*., 15, 505-514 (1980).

Kalb et al., "Spinning of High Molecular Weight Polyethylene Solution and Subsequent Drawing in a Temperature Gradient", *Poly. Bull*., 1 , 871-876 (1979).

Kalb et al., "Hot Drawing of Porous High Molecular Weight Polyethylene", *Polymer*, 21, 3-4 (1980).

Smook et al., "Influence of Spinning/Hot Drawing Conditions on the Tensile Strength of Porous High Molecular Weight Polyethylene", *Poly. Bull*., 2, 775-783 (1980).

Smith et al., "Ultradrawing of High Molecular-Weight PE Cast From Solution. II Influence of Intial Polymer Concentration", *J. Appl. Poly. Sci.., Poly. Phys Ed*., 19, 877-888 (1981).

Smook et al., "Effect of Temp. & Deformation Rate on Hot Drawing Behavior of Porous High-Mol.-Wt. PE Fibers", *J. Appl. Poly. Sci.., Poly. Phys Ed*., 27, 2209-2228 (1982).

Smook et al., "Elastic Flow Instabilities and Shish-kebab Formation During Gel-spinning of Ultra-high Mol. Wt. PE", J. Matl. Sci., 19, 31-43 (1984).

Pennings et al., Mechanical Properties of Ultra-high Mol. Wt. PE in Relation to Structural Changes & Chain Scissioning upon Spinning & Hot Drawing, *J. Matl. Sci*.,19, 3443 (1984).

Penning et al., "The Effect of Fibre Diameter on the Drawing Behaviour of Gel-spun Ultra-High Molecular Weight Polyethylene Fibres", *Poly. Bull*, 31, 243-248 (1993).

* cited by examiner

Highly Oriented Yarn Tenacity vs POY Tenacity

PROCESS FOR THE PREPARATION OF UHMW MULTI-FILAMENT POLY(ALPHA-OLEFIN) YARNS

CROSS-REFERENCE TO RELATED APPLICATIONS

This application claims the benefit of U.S. provisional application Ser. No. 60/839,594, filed Aug. 23, 2006.

BACKGROUND OF THE INVENTION

1. Field of the Invention

This invention relates to a process for preparing ultra-high molecular weight poly(alpha-olefin) (hereinafter. UHMWPO) multi-filament yarns and the yarns produced thereby.

2. Description of the Prior Art

UHMWPO multi-filament yarns have been produced possessing high tensile properties such as tenacity, tensile modulus and energy-to-break. The yarns are useful in applications requiring impact absorption and ballistic resistance such as body armor, helmets, breast plates, helicopter seats, spall shields; composite sports equipment such as kayaks, canoes bicycles and boats; and in fishing line, sails, ropes, sutures and fabrics.

Ultra-high molecular weight poly(alpha-olefins) include polyethylene, polypropylene, poly(butene-1), poly(4-methyl-pentene-1), their copolymers, blends and adducts. Multi-filament "gel spun" ultra-high molecular weight polyethylene (UHMWPE) yarns are produced, for example, by Honeywell International Inc. The gel-spinning process discourages the formation of folded chain molecular structures and favors formation of extended chain structures that more efficiently transmit tensile loads.

The first description of the preparation and drawing of single UHMWPE filaments in the gel state was by P. Smith. P. J. Lemstra, B. Kalb and A. J. Pennings, *Poly. Bull.,* 1, 731 (1979). Single filaments of UHMWPE were spun from solution and drawn while evaporating the solvent. Further descriptions of the drawing of polyethylene filaments containing substantial concentrations of solvent such as decalin or wax are described, for example, in P. Smith and P. J. Lemstra, *Macromol. Chem.,* 180, 2983 (1979): J. Matl. Sci., 15, 505 (1980): and in the following patents and patent applications: GB 2,042,414A; GB 2,051,667B, U.S. Pat. Nos. 4,411,854: 4,422,993; 4,430,383: 4,436,689; EP 0 077.590; U.S. Pat. Nos. 4,617,233; 4,545,950; 4,612,148; 5,246,657; 5,342,567; EP 0 320,188 A2 and JP-A-60/5264, U.S. Pat. No. 4,422,993 discloses that higher draw ratios can be achieved in drawing solvent-containing filaments than with filaments containing little or no solvent and that drawing of solvent-containing filaments results in higher tensile properties.

The drawing of gel-spun high strength polyethylene filaments in essentially a diluent-free state was first described by B. Kalb and A. J. Pennings, *Poly. Bull.,* 1, 871 (1979). Single filaments were spun from dodecane solution and simultaneously dried and stretched in a heated tube under an increasing temperature of 100 to 148° C. A dried filament of about 10 g/d (9 g/dtex) tenacity was then re-stretched at 153° C. to a tenacity of about 29 g/d (26.1 g/dtex).

Further descriptions of the drawing of gel-spun polyethylene filaments in an essentially diluent-free state are described, for example, in B. Kalb and A. J. Pennings, *Polymer,* 21, 3 (1980); J. Smook et. al, *Poly. Bull.,* 2, 775 (1980); P. Smith et el., *J. Poly Sci., Poly Phys. Ed.,* 19, 877 (1981); J. Smook and A. J. Pennings, *J. Appl. Poly. Sci.,* 27, 2209 (1982), *J. Matl. Sci.,* 19, 31 (1984), *J. Matl. Sci.,* 19, 3443 (1984): J. P. Penning et al., *Poly. Bull.,* 31, 243 (1993); Japan Kokai Patent Publication 238416-1995; and in the following U.S. Pat. Nos. 4,413,110; 4,536,536; 4,551,296; 4,663,101; 5,032,338; 5,286,435; 5,578,374; 5,736,244; 5,741,451; 5,958,582; 5,972,498; and 6,448,359.

More recent processes (see, e.g., U.S. Pat. Nos. 4,551,296; 4,663,101; 6,448,659; and 6,969,553) describe drawing all three of the solution filaments, the gel filaments and the solvent-free filaments. Yet another recent drawing processes is described in co-pending United States published application 20050093200. The disclosures of the aforementioned U.S. Pat. Nos. 4,551,296, 4,663,101, 5,741,451, 6,448,659, and 6,969,553 and United States published application 20050093200 are hereby expressly incorporated by reference to the extent not incompatible herewith.

The first description of the preparation and drawing of multi-filament yarns of UHMWPO was in U.S. Pat. No. 4,413,110. The first process where essentially diluent-free dry yarns were drawn in-line with spinning and then were redrawn off-line was described in U.S. Pat. No. 5,741,451. It will be understood that the terms "in-line" and "off-line" refer to a continuous sequential operation and a discontinuous sequential operation respectively.

Although each of the foregoing documents represented an advance in the state of the art, it would be desirable to provide a process for preparing UHMWPO multi-filament yarns having improved tensile properties at higher productivity.

SUMMARY OF THE INVENTION

In accordance with this invention, there is provided a process for the production of a multi-filament poly(alpha-olefin) yarn comprising the steps of:

a) forming a solution of a poly(alpha-olefin) in a solvent at an elevated temperature, the poly(alpha-olefin) having an intrinsic viscosity when measured in decalin at 135° C. of from about 5 to about 45 dl/g;

b) passing the solution through a multi-filament spinneret to form a solution yarn, the spinneret being at an elevated temperature;

c) drawing the solution yarn at a draw ratio of from about 1.1:1 to about 30:1;

d) rapidly cooling the solution yarn to a temperature below the gel point of the solution to form a gel yarn;

e) drawing the gel yarn in at least one stage at a draw ratio of from about 1.1:1 to about 30:1;

f) removing solvents from the gel yarn while drawing to form an essentially dry yarn containing less than about 10 weight percent of solvents;

g) drawing the dry yarn in at least one stage to form a partially oriented yarn having a tenacity of from about 12 to about 25 g/d;

h) optionally relaxing the partially oriented yarn from about 0.5 to about 5 percent of its length;

i) winding up the partially oriented yarn;

j) unrolling the partially oriented yarn and drawing it in at least one stage at a temperature of from about 130° C. to about 160° C. to a draw ratio of from about 1.8:1 to about 10:1 to form a highly oriented yarn having a tenacity of from about 38 to about 70 g/d (34.2 to 63 g/dtex); and k) cooling the highly oriented yarn under tension and winding up the highly oriented yarn;

wherein steps a) through i) are conducted continuously in sequence and are discontinuous with continuous sequential steps j) to k).

Also in accordance with this invention, there is provided a process for the production of a multi-filament poly(alpha-olefin) yarn comprising the steps of:

a) forming a solution of a poly(alpha-olefin) in a solvent at an elevated temperature, the poly(alpha-olefin) having an intrinsic viscosity when measured in decalin at 135° C. of from about 5 to about 45 dl/g:

b) passing the solution through a multi-filament spinneret to form a solution yarn, the spinneret being at an elevated temperature;

c) drawing the solution yarn at a draw ratio of from about 1.1:1 to about 30:1;

d) rapidly cooling the solution yarn to a temperature below the gel point of the solution to form a gel yarn;

e) drawing the gel yarn in at least one stage at a draw ratio of from about 1.1:1 to about 30:1;

f) removing solvents from the gel yarn while drawing to form an essentially dry yarn containing less than about 10 weight percent of solvents;

g) maximally drawing the dry yarn in at least one stage until the last of such stages is at a draw ratio of less than or equal to about 1.2:1 thereby forming a partially oriented yarn;

h) optionally relaxing the partially oriented yarn partially oriented yarn from about 0.5 to about 5 percent of its length;

i) winding up the partially oriented yarn;

j) unrolling the partially oriented yarn and drawing it in at least one stage at a temperature of from about 130° C. to about 160° C. to a draw ratio of from about 1.8:1 to about 10:1 to form a highly oriented yarn having a tenacity of from about 38 to about 70 g/d (34.2 to 63 g/dtex); and k) cooling the highly oriented yarn under tension and winding up the highly oriented yarn;

wherein steps a) through i) are conducted continuously in sequence and are discontinuous with continuous sequential steps j) to k).

Further in accordance with this invention, there is provided a process for the production of a multi-filament poly(alpha-olefin) yarn comprising the steps of:

a) forming a solution of a poly(alpha-olefin) in a solvent at an elevated temperature, the poly(alpha-olefin) having an intrinsic viscosity when measured in decalin at 135° C. of from about 5 to about 45 dl/g;

b) passing the solution through a multi-filament spinneret to form a solution yarn, the spinneret being at an elevated temperature;

c) drawing the solution yarn at a draw ratio of from about 1.1:1 to about 30:1;

d) rapidly cooling the solution yarn to a temperature below the gel point of the solution to form a gel yarn;

e) drawing the gel yarn in at least one stage at a first draw ratio DR1;

f) removing solvents from the gel yarn while drawing at a second draw ratio DR2 to form an essentially dry yarn containing less than about 10 weight percent of solvents;

g) drawing the dry yarn at a third draw ratio DR3 of from about 1.10:1 to about 2.00:1 in at least one stage to form a partially oriented yarn;

h) optionally relaxing the partially oriented yarn from about 0.5 to 5 percent of its length;

i) winding up the partially oriented yarn;

j) unrolling the partially oriented yarn and drawing the partially oriented yarn in at least one stage at a temperature of from about 130° C. to about 160° C. to a fourth draw ratio DR4 of from about 1.8:1 to about 10:1 to form a highly oriented yarn having a tenacity of from about 35 to about 70 g/d (34.2 to 63 g/dtex); and k) cooling highly oriented yarn under tension and winding it up;

wherein the product of the draw ratios DR1×DR2×DR3 is greater than or equal to about 5:1, wherein the fractional off-line draw of the dry yarn (FOLDY), defined by the relationship $$FOLDY = \frac{\log(DR4)}{\log(DR3 * DR4)},$$

is from about 0.75 to about 0.95, and wherein steps a) through i) are conducted continuously in sequence and are discontinuous with continuous sequential steps j) to k). It will be understood that the asterisk (*) in the above expression for FOLDY denotes multiplication.

This invention also includes the yarns produced by any of the foregoing processes.

It has been found that the processes of this invention provide ultra-high molecular weight poly(alpha-olefin) multi-filament yarns having improved tensile properties at high productivities.

DETAILED DESCRIPTION OF THE INVENTION

Figure 1:
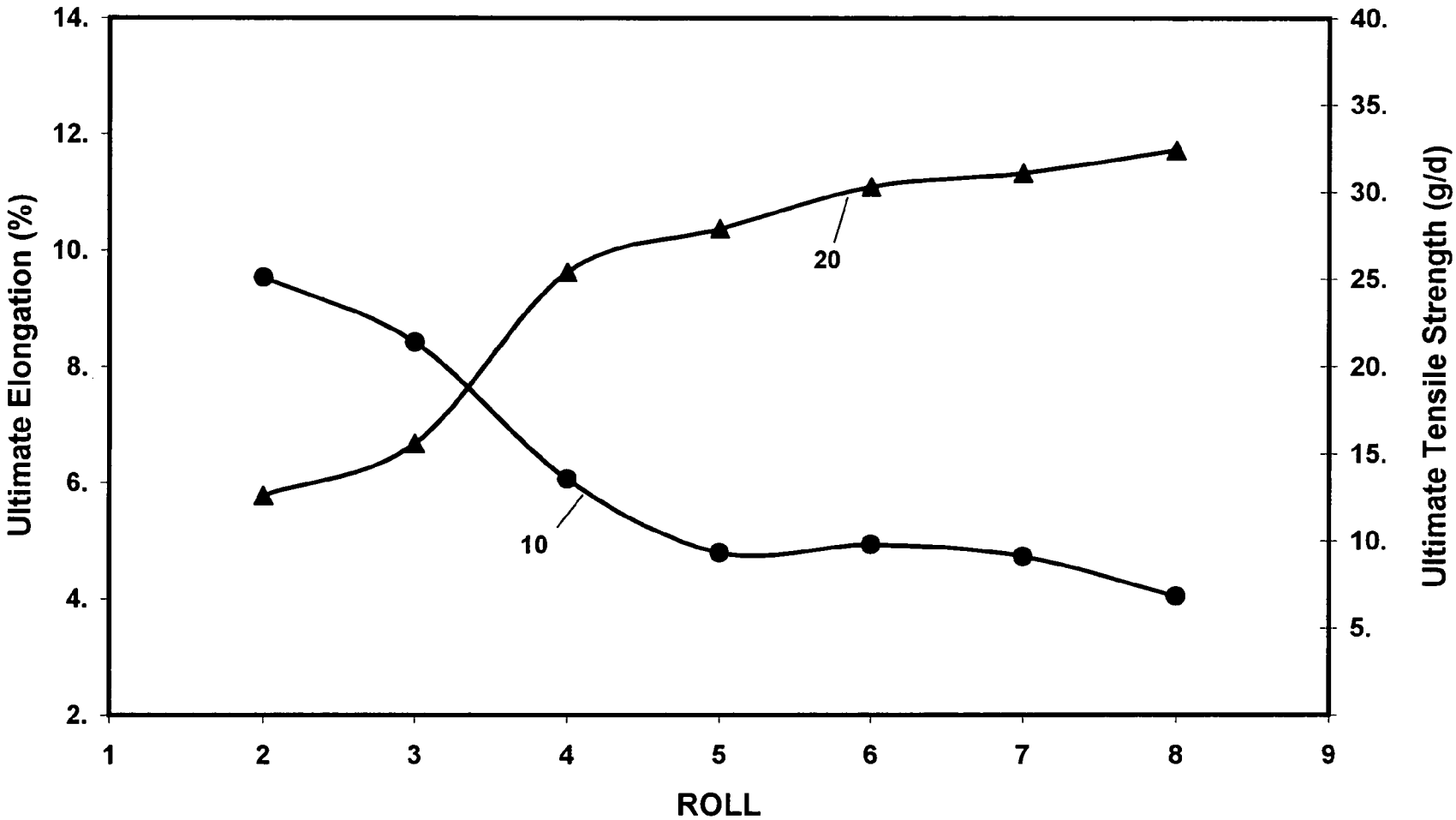
FIG. 1 is a plot showing the progression of tensile properties in a process comparative to the process of this invention.

This invention provides a process of preparing ultra-high molecular weight poly(alpha-olefin) (UHMWPO) multi-filament yarns having improved tensile properties at higher productivity. UHMWPOs include polyethylene, polypropylene, poly(butene-1), poly(4-methyl-pentene-1), their copolymers, blends and adducts. For the purposes of the invention, an UHMWPO is defined as one having an intrinsic viscosity when measured in decalin at 135° C. of from about 5 to about 45 dl/g.

For purposes of the invention, a fiber is an elongate body the length dimension of which is much greater than the transverse dimensions of width and thickness. Accordingly, the term fiber includes filament, ribbon, strip and the like having regular or irregular cross-section. A yarn is a continuous strand comprised of many fibers or filaments.

"Gel spinning" involves the formation of a solution of an UHMWPO, passage of the solution through a spinneret to form a solution filament, cooling of the solution filament to form a gel filament, removal of the spinning solvent to form an essentially dry filament, and stretching at least one of the solution filament, the gel filament or the dry filament. The production of UHMWPO multi-filament yarns having high tensile properties depends on achieving a high degree of molecular alignment and orientation through drawing.

In most previous gel spinning processes, only the solution yarns and/or the gel or solvent swollen yarns were drawn in-line with spinning often in combination with solvent removal. The dry fibers were drawn in an off-line operation or not drawn at all. In another prior process described in U.S. Pat. No. 5,342,567, the gel fibers and the dry fibers were drawn only in-line with spinning and not off-line. In U.S. Pat. No. 5,741,451 the solution fibers, the gel fibers and the dry fibers were drawn in-line with spinning to tenacities of 29-30 g/d (26.1-27 g/dtex) and then re-drawn off-line to tenacities of 34-37 g/d (30.6-33.3 g/dtex).

It has been found that the highest levels of molecular alignment and orientation are obtained when all three of the solution filaments, the gel filaments and the dry filaments are drawn. Moreover, it is believed that the effectiveness of a given draw ratio increases as the filament state changes from the solution state, to the gel or solvent swollen state, and finally to the dry state. It has also been found that drawing in a dry state can be most effective in producing high molecular alignment when the draw rate is maintained within certain bounds (see the aforementioned U.S. Pat. No. 6,969,553 and United States published application 20050093200). However, as draw rate, draw ratio and yarn speed are inter-related in a continuous process, an upper bound on draw rate places a restriction on either the draw ratio and tensile properties, or else the yarn speed and consequent process productivity. The present invention provides a solution to this problem by providing a gel spinning process that achieves both high yarn tensile properties and high productivity, in which the process is continuous only to a certain point and then interrupted, with drawing of the dry yarns continuing off-line from the spinning.

The UHMWPO used in the process of the invention is preferably selected from the group consisting of polyethylene, polypropylene, poly(butene-1), poly(4-methyl-pentene-1), their copolymers and adducts. More preferably, the UHMWPO is a polyethylene with less than one pendent side group per 100 carbon atoms, still more preferably less than one side group per 300 carbon atoms, yet more preferably less than one side group per 500 carbon atoms, and most preferably less than side group per 1000 carbon atoms. Side groups may include, but are not limited to, C1-C10 alkyl groups, vinyl terminated alkyl groups, norbornene, halogen atoms, carbonyl, hydroxyl, epoxide and carboxyl. The UHMWPO may contain small amounts, generally less than about 5 weight percent, and preferably less than about 3 weight percent, of additives such as anti-oxidants, thermal stabilizers, colorants, flow promoters, solvents, and the like.

The UHMWPO is dissolved in a spinning solvent at an elevated temperature. The spinning solvent has an atmospheric boiling point at least as high as the gel point of the UHMWPO solution to be formed. The spinning solvent is preferably selected from the group consisting of hydrocarbons such as aliphatics, cycloaliphatics and aromatics, halogenated hydrocarbons such as dichlorobenzene, and mixtures thereof. Most preferred spinning solvents are mineral oil, decalin, low molecular weight paraffin wax, and mixtures thereof.

The solution of the UHMWPO in the spinning solvent may be prepared by any suitable method such as described, for example, in U.S. Pat. Nos. 4,536,536, 4,668,717, 4,784,820 and 5,032,538. Preferably, the solution of the UHMWPO is formed by the process of co-pending application Ser. No. 11/393,218, filed Mar. 30, 2006, the disclosure of which is hereby expressly incorporated by reference to the extent not incompatible herewith. The concentration of the UHMWPO in the spinning solvent may range from about 1 to about 75 weight percent, wt. %, preferably from about 5 to about 50 weight percent, and more preferably from about 5 to about 35 weight percent.

The UHMWPO solution is passed continuously through a multi-filament spinneret to form a solution yarn. Preferably, the spinneret has from about 10 to about 3000 spinholes and the solution yarn comprises from about 10 to about 3000 filaments. More preferably, the spinneret has from about 100 to about 2000 spinholes and the solution yarn comprises from about 100 to about 2000 filaments. Preferably, the spinholes have a conical entry, with the cone having an included angle from about 15 to about 75 degrees. Preferably, the included angle is from about 30 to about 60 degrees. Also preferably, following the conical entry, the spinholes have a straight bore capillary extending to the exit of the spinhole. The capillary preferably has a length to diameter ratio from about 10 to about 100, more preferably from about 15 to about 40.

The solution yarn issuing from the spinneret is passed continuously through a gaseous zone in which it is preferably drawn at a draw ratio of from about 1.1:1 to about 30:1. The gaseous zone may be a cooling chimney wherein the solution yarn is simultaneously drawn and rapidly cooled by a cooling gas flow and evaporation of a volatile spinning solvent, or the solution is yarn may be passed through a short gas-filled space where it is drawn, with or without cooling and evaporation, and then passed into a liquid quench bath where it is rapidly cooled.

The solution yarn is cooled to a temperature below the gel point of the UHMWPO solution to form a gel yarn. The average cooling rate of a filament of the yarn over the temperature interval between the spinneret temperature and 115° C. is preferably at least about 100° C./sec and more preferably is at least about 500° C./sec.

The average cooling rate of a filament of the yarn over that temperature interval is as follows:

$$\text{Avg. cooling rate, ° C./sec} = (T_{spinneret} - 115)/t$$

where: $T_{spinneret}$ is the spinneret temperature, ° C., and
t is the time in seconds required to cool the average temperature of a filament cross-section to 115° C.

If the solution yarn passes through a short gas-filled space into a liquid quench bath without substantial cooling or evaporation, the time required to cool a filament in the quench batch is calculated from Equation 7.7(9) at page 202 of "Conduction of Heat in Solids", H. S. Carslaw and J. C. Jaeger, Second Edition, Oxford at the Clarendon Press, London, 1959. It is assumed that any drawing of the solution filament occurs in the gas-filled space and that the radius of the filament in the quench bath is constant. The coefficient of heat transmission at the surface of the filament is taken as follows:

$$h = 0.9466 \frac{k}{D_i}\left(\frac{VD_f \rho C_p}{2k}\right)^{0.5705} \text{cal-cm}^2/\text{sec}$$

where: V is the filament velocity, cm/sec
$D_f$ is the filament diameter, cm
$C_p$ is the specific heat of the quench bath liquid, cal/g-° C.
ρ is the density of the quench bath liquid, g/cm$^3$
k is the thermal conductivity of the quench bath liquid, cal/sec-cm$^2$-° C./cm If the solution yarn is passed into a spinning chimney or through a substantial gas-filled space where cooling and evaporation take place, the cooling rate of a filament is calculated from a finite element analysis as is known in the art. An example of a commercially available computer program that can accomplish this calculation is CFdesign from Blue Ridge Numerics, Inc, Charlottesville, Va.

The gel yarn formed by cooling the solution yarn is continuously drawn in-line in one or more stages at a first draw ratio DR1 of from about 1.1:1 to about 30:1. Preferably, at least one stage of drawing of the gel yarn is conducted without applying heat to the yarn. Preferably, at least one stage of drawing of the gel yarn is conducted at a temperature less than or equal to about 25° C. Drawing of the gel yarn may be conducted simultaneously with solvent removal at a second draw ratio DR2.

A volatile spinning solvent may be continuously removed from the gel yarn by drying. An apparatus suitable for this purpose is described, for example, in United States published application 20040040176. Alternatively, the spinning solvent may be continuously removed from the gel yarn by extraction with a low boiling second solvent followed by drying. An apparatus suitable for a continuous extraction step is described, for example, in U.S. Pat. No. 4,771,616.

Removal of the spinning solvent results in essentially dry yarn containing less than about 10 weight percent of solvents. Preferably, the dry yarn contains less than about 5 weight percent and more preferably, less than about 2 weight percent of solvents.

The dry yarn is continuously drawn in-line at a third draw ratio DR3 in at least one stage to form a partially oriented yarn (POY). The third draw ratio is preferably from about 1.10:1 to about 2.00:1. Preferably, the combined draw of the gel yarn and the dry yarn, DR1×DR2×DR3, is at least about 5:1, more preferably at least about 10:1, yet more preferably at least about 15:1 and most preferably at least about 20:1. Preferably, the dry yarn is maximally drawn in-line until the last stage of draw is at a draw ratio less than about 1.2:1.

Optionally, the last stage of draw is followed by relaxation of the dry yarn from about 0.5 percent to about 5 percent of its length.

The POY preferably has a tenacity of at least about 12 g/d (10.8 g/dtex). Preferably, the POY has a tenacity from about 12 g/d to about 25 g/d (10.8 g/dtex to 22.5 g/dtex)), and more preferably from about 14 to about 22 g/d (12.6 to 19.8 g/dtex). For the purposes of the invention, tenacity is measured in accordance with ASTM D2256-02 at 10 inch (25.4 cm) gauge length and a strain rate of 100%/min.

The continuous in-line production of the POY is at a rate of least about 0.35 g/min per filament of the POY, preferably at least about 0.60 g/min per filament, more preferably at least about 0.75 g/min per filament, and most preferably at least about 1.00 g/min per filament. The POY is then wound up as yarn packages or on a beam, preferably without twist being imparted to the yarn.

The POY is then transferred to an off-line drawing operation where it is unrolled and drawn in at least one stage at temperature(s) of from about 130° C. to about 160° C. to a fourth draw ratio DR4 of from about 1.8:1 to about 10:1 to form a highly oriented yarn (HOY) product. Preferably, the fractional off-line draw of the dry yarn (FOLDY), defined by the relationship $$FOLDY = \frac{\log(DR4)}{\log(DR3 * DR4)},$$

is from about 0.75 to about 0.95. It will be understood that the asterisk (*) in the above expression for the FOLDY denotes multiplication.

Preferably, the POY is drawn in a forced convection oven and preferably the POY is drawn in air. It is preferred that the POY is drawn under the conditions described in the aforementioned U.S. Pat. No. 6,969,553 or in United States published application 20050093200. The HOY product has a tenacity of from about 38 to about 70 g/d (34.2 to 63 g/dtex), preferably from about 40 to about 70 g/d (36 to 63 g/dtex), and most preferably from about 50 to about 70 g/d (45 to 63 g/dtex). The HOY is then cooled under tension and wound up.

The following non-limiting examples are presented to provide a more complete understanding of the invention. The specific techniques, conditions, proportions and reported data set forth to illustrate the invention are exemplary and should not be construed as limiting the scope of the invention.

COMPARATIVE EXAMPLE

A slurry was prepared in an agitated mix tank containing 8 wt. % of an UHMWPO and 92 wt. % of white mineral oil. The UHMWPO was a linear polyethylene having an intrinsic viscosity of 18 dl/g in decalin at 135° C. The linear polyethylene had fewer than about 0.5 substituents per 1000 carbon atoms, and a melting point of 138° C. The white mineral oil was HYDROBRITE® 550 PO, a low volatility oil from Crompton Corporation, containing about 70% paraffinic carbon and about 30% of naphthenic carbon.

The slurry was continuously converted into a solution by passage through a heated pipe and then passed through a gear pump, a spin block and a multi-hole spinneret to form a multi-filament solution yarn. The solution yarn issuing from the spinneret was stretched about 2:1 on passing through an air gap into a water quench bath at a temperature of about 12° C. to form a gel yarn.

The gel yarn was stretched 5:1 at room temperature, passed counter-current to a stream of trichlorotrifluoroethane to extract the mineral oil and through a dryer to substantially evaporate the trichlorotrifluoroethane. The gel yarn was additional stretched about 2:1 during extraction and drying.

The dry yarn was passed continuously from the dryer through a series of from two to eight draw rolls constituting from one to seven draw stages at temperatures of 130° C. to 150° C. The continuous in-line production rate was 0.28 g/min per filament.

A sample of the drawn yarn was collected after each draw stage at rolls 2, 3, 4, 5, 6, 7 and 8 and submitted for laboratory tensile testing. FIG. 1 is a plot of the tenacity 20 and the ultimate elongation 10 of the yarns collected as a function of the draw roll number.

It will be seen that up to draw roll number 4, corresponding to the end of the third draw stage, the yarn tenacity 20 increased rapidly, and thereafter increased much more slowly. Similarly, the ultimate elongation 10 decreased rapidly up to draw roll number 4 and thereafter much more slowly.

The tenacity of the partially oriented yarn collected after roll number 4 was 25 g/d (22.5 g/dtex). The tenacity of the yarn collected after roll number 8 was 32 g/d (28.8 g/dtex).

The yarn wound up after roll number 8 was transferred to an off-line drawing apparatus and post-stretched by the process of U.S. Pat. No. 5,741,451. The post-stretched yarn had a tenacity of 36 g/d (32.4 g/dtex).

Example 1

A slurry was prepared in an agitated mix tank at room temperature containing of 10 wt. % of an UHMWPO and 90 wt. % of white mineral oil. The UHMWPO was a linear polyethylene having an intrinsic viscosity of 20 dl/g in decalin at 135° C. The linear polyethylene had fewer than about 0.5 substituents per 1000 carbon atoms, and a melting point of 138° C. The white mineral oil was HYDROBRITE® 550 PO, a low volatility oil from Crompton Corporation, containing about 70% paraffinic carbon and about 30% of naphthenic carbon.

The slurry was continuously converted into a solution by passage through a twin screw co-rotating extruder, a vessel to provide additional residence time and then passed through a gear pump, a spin block and a multi-hole spinneret to form a multi-filament solution yarn. The solution yarn issuing from the spinneret was stretched 1.9:1 on passing through an air gap into a water quench bath at a temperature of about 12° C. to form a gel yarn. The solution yarn was cooled at the rate of about 550° C./min between the spinneret temperature and 115° C.

The gel yarn was stretched at a first draw ratio DR1 of 5:1 at room temperature, passed counter-current to a stream of trichlorotrifluoroethane to extract the mineral oil and through a dryer to substantially evaporate the trichlorotrifluoroethane. The gel yarn was additionally stretched at a second draw ratio DR2 of 2.1:1 during extraction and drying. The essentially dry yarn containing less than about 10 wt. % of solvents was stretched in two stages at a temperature of 143° C. to a third draw ratio DR3 of 1.22:1 to form a POY. The final in-line draw was at a ratio less than 1.2:1.

The POY had a tenacity of 17.6 g/d (15.8 g/dtex), a tensile modulus (Young's modulus) of 296 g/d (266 g/dtex) and an elongation at break of 8.35%. The POY was wound up at the rate of 0.501 g/min per filament without twist. The above process was continuous and unbroken from solution formation to winding of the POY. The product DR1×DR2×DR3 was 12.2.

The POY was transferred to an off-line stretching apparatus where it was stretched at a fourth draw ratio DR4 of 4.8:1 at a temperature of 150° C. under conditions described in United States published application 20050093200 to form a highly oriented yarn (HOY). The fractional off-line draw of the dry yarn was:

$$FOLDY = \frac{\log(4.8)}{\log(1.22 * 4.8)} = 0.888$$

The HOY was cooled under tension and wound up. It had a tenacity of 40.1 g/d, a tensile modulus of 1300 g/d and an elongation at break of 3.3%. The tensile properties of this HOY and the POY from which it was made are shown in Table I.

Figure 2:
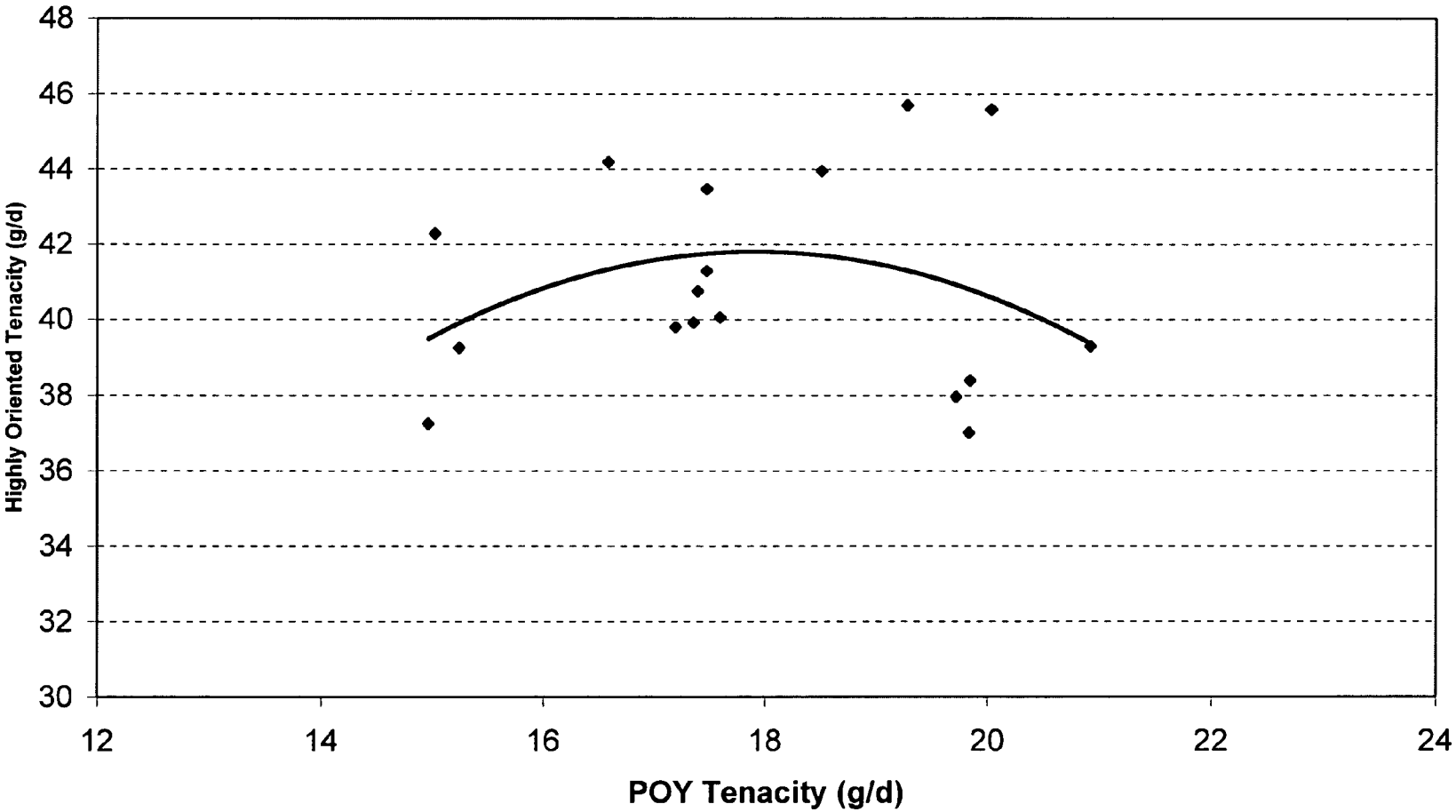
FIG. 2 is a plot showing the relationship of the tenacity of a highly oriented yarn to the tenacity of the partially oriented yarn (POY) from which it was produced.
Figure 3:
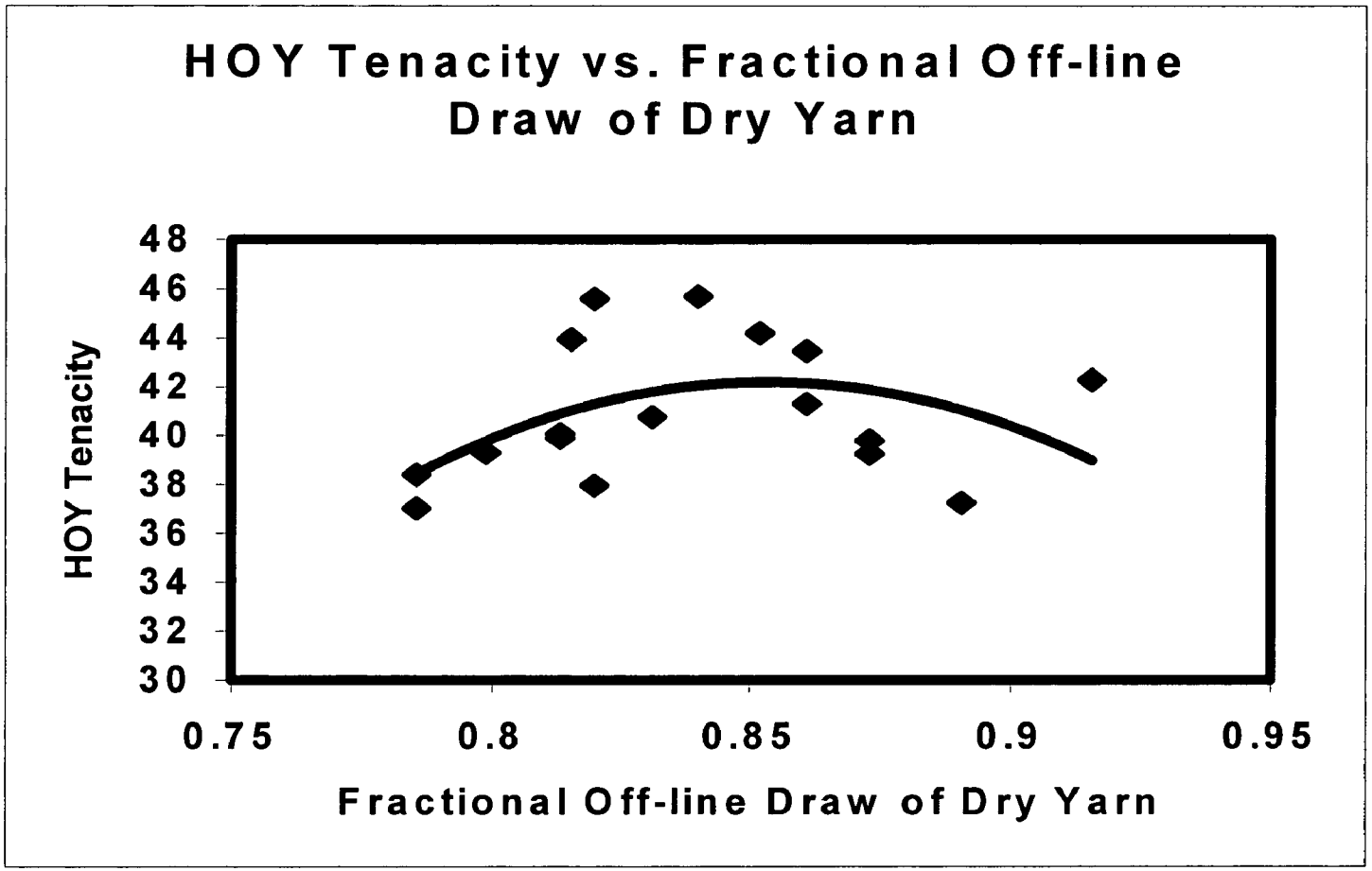
FIG. 3 is a plot showing the relationship of the tenacity of a highly oriented yarn (HOY) to the fractional off-line draw of the dry yarn.

The HOY tenacity is plotted in FIG. 2 versus the tenacity of the POY from which it was produced and in FIG. 3 versus the fractional off-line draw of the dry yarn.

Examples 2-16

Example 1 was repeated in its entirety with only unsubstantial differences in the draw ratios of the gel yarns and the dry yarns. The tensile properties of the POYs and the HOYs produced therefrom are shown in Table I and their tenacities are plotted in FIGS. 2 and 3. The solid lines in FIGS. 2 and 3 are the trend lines of the data. The data indicate that the tenacity of a HOY is generally highest when the POY tenacity is in the range of about 12 to about 25 g/d (10.8 to 22.5 g/dtex), and/or, when the fractional off-line draw of the dry yarn is in the range of about 0.75 to about 0.95.

It will be seen that the tensile properties achieved in the process of the invention, are superior to those obtained in the process of the Comparative Example, where all drawing of the dry yarn was done in-line. The process of the invention thus fulfills a need for both a yarn that has high properties and can be produced with high productivity.

Having thus described the invention in rather full detail, it will be understood that such detail need not be strictly adhered to but that further changes and modifications may suggest themselves to one skilled in the art, all falling with the scope of the invention as defined by the subjoined claims.

TABLE I

| | POY | | | | | Highly Oriented Yarn | | | | |
|---|---|---|---|---|---|---|---|---|---|---|
| | Tenacity | | Tensile Modulus | | % | Tenacity | | Tensile Modulus | | % |
| Ex. No. | g/d | g/dtex | g/d | g/dtex | Elong. | g/d | g/dtex | g/d | g/dtex | Elong. |
| 1 | 17.6 | 15.8 | 296 | 266 | 8.4 | 40.1 | 36.1 | 1300 | 1170 | 3.3 |
| 2 | 17.4 | 15.6 | 292 | 263 | 8.4 | 39.9 | 35.9 | 1303 | 1173 | 3.4 |
| 3 | 17.4 | 15.7 | 288 | 259 | 8.5 | 40.8 | 36.7 | 1312 | 1181 | 3.3 |
| 4 | 19.8 | 17.9 | 373 | 336 | 7.6 | 38.4 | 34.6 | 1255 | 1130 | 3.1 |
| 5 | 19.8 | 17.8 | 372 | 335 | 7.4 | 37.0 | 33.3 | 1254 | 1129 | 3.0 |
| 6 | 20.0 | 18.0 | 354 | 318 | 7.4 | 45.6 | 41.0 | 1455 | 1310 | 3.4 |
| 7 | 19.7 | 17.7 | 355 | 319 | 7.4 | 38.0 | 34.2 | 1259 | 1133 | 3.2 |
| 8 | 20.9 | 18.8 | 399 | 359 | 7.0 | 39.3 | 35.4 | 1291 | 1162 | 3.4 |
| 9 | 17.5 | 15.7 | 288 | 259 | 7.9 | 41.3 | 37.2 | 1324 | 1192 | 3.3 |
| 10 | 17.5 | 15.7 | 289 | 260 | 8.0 | 43.5 | 39.1 | 1353 | 1218 | 3.4 |
| 11 | 19.3 | 17.3 | 336 | 303 | 7.5 | 45.7 | 41.1 | 1496 | 1346 | 3.5 |
| 12 | 17.2 | 15.5 | 282 | 254 | 8.1 | 39.8 | 35.8 | 1338 | 1204 | 3.3 |
| 13 | 15.2 | 13.7 | 232 | 209 | 8.7 | 39.3 | 35.3 | 1339 | 1205 | 3.3 |
| 14 | 15.0 | 13.5 | 229 | 206 | 8.6 | 42.3 | 38.1 | 1386 | 1247 | 3.3 |
| 15 | 18.5 | 16.7 | 327 | 294 | 7.7 | 44.0 | 39.6 | 1496 | 1346 | 3.2 |
| 16 | 16.6 | 14.9 | 273 | 245 | 8.2 | 44.2 | 39.8 | 1407 | 1266 | 3.4 |

What is claimed is:

1. A process for the production of a multi-filament poly (alpha-olefin) yarn comprising the steps of:

a) forming a solution of a poly(alpha-olefin) in a solvent at an elevated temperature, said poly(alpha-olefin) having an intrinsic viscosity when measured in decalin at 135° C. of from about 5 to about 45 dl/g;

b) passing said solution through a multi-filament spinneret to form a solution yarn, said spinneret being at an elevated temperature;

c) drawing said solution yarn at a draw ratio of from about 1.1:1 to about 30:1;

d) rapidly cooling said solution yarn to a temperature below the gel point of said solution, to form a gel yarn;

e) drawing said gel yarn in at least one stage to a first draw ratio DR1;

f) removing solvents from said get yarn while drawing at a second draw ratio DR2 in at least one stage to form an essentially dry yarn containing less than about 10 weight percent of solvents;

g) drawing said dry yarn to a third draw ratio DR3 of from about 1.10:1 to about 2.00:1 in at least one stage to form a partially oriented yarn;

h) optionally relaxing said partially oriented yarn from about 0.5 to about 5% of its length;

i) winding up said partially oriented yarn;

j) unrolling said partially oriented yarn and drawing it in at least one stage at a temperature of from 130° C. to 160° C. to a fourth draw ratio DR4 f from about 1.8:1 to about 10:1 to form a highly oriented yarn having a tenacity of from about 38 to about 70 g/d (34.2 to 63 g/dtex) as measured by ASTM D2256-02 at 10 inch (25.4 cm) gauge length and a strain rate of 100%/min;

k) cooling said highly oriented yarn under tension and winding it up;

wherein the product of the draw ratios DR1×DR2×DR3 is greater than or equal to about 5:1, wherein the fractional off-line draw of the dry yarn (FOLDY), defined by the relationship, is from about 0.75 to about 0.95, and wherein steps a) through i) are conducted continuously in sequence and are discontinuous with continuous sequential steps j) to k).

2. The process as claimed in claim 1, wherein the drawing in step j) includes drawing the partially oriented yarn in a forced convection air oven.

3. The process as claimed in claim 1, wherein said partially oriented yarn is produced at a rate of at least about 0.35 g/min per filament of said partially oriented yarn.

4. The process as claimed in claim 1, wherein said partially oriented yarn is produced at a rate of at least about 0.60 g/min per filament of said partially oriented yarn.

5. The process as claimed in claim 1, wherein said partially oriented yarn is produced at a rate of at least about 0.75 g/min per filament of said partially oriented yarn.

6. The process as claimed in claim 1, wherein said partially oriented yarn is produced at a rate of at least about 1.00 g/min per filament of said partially oriented yarn.

7. The process as claimed in claim 1, wherein said poly (alpha-olefin) is a polyethylene.

8. The process as claimed in claim 1, wherein said cooling in step d) is conducted such that the average cooling rate of a filament of the yarn over the temperature interval between the spinneret temperature and 115° C. is at least about 100° C./sec.

9. The process as claimed in claim 1, wherein said cooling in step d) is conducted such that the average cooling rate of a filament of the yarn over the temperature interval between the spinneret temperature and 115° C. is at least about 500° C./sec.

10. The process as claimed in claim 1, wherein the gel yarn is drawn in at least one stage at a temperature less than or equal to about 25° C.

11. The process as claimed in claim 1, wherein solvents are removed from said gel yarn in step f) to form an essentially dry yarn containing less than about 5 weight percent of solvents.

12. The process as claimed in claim 1, wherein solvents are removed from said gel yarn in step f) to form an essentially dry yarn containing less than about 2 weight percent of solvents.

13. The process as claimed in claim 1, wherein said partially oriented yarn is wound up without twist being imparted to the yarn.

14. The process as claimed in claim 1, wherein said partially oriented yarn is relaxed from about 0.5 to about 5 percent of its length.

15. The process as claimed in claim 1, wherein said highly oriented yarn has a tenacity of from about 50 to about 70 g/d (45 to 63 g/dtex) as measured by ASTM D2256-02 at 10 inch (25.4 cm) gauge length and a strain rate of 100%/min.

16. The process as claimed in claim 1, wherein said solvent is selected from the group consisting of hydrocarbons, halogenated hydrocarbons, and mixtures thereof.

17. The process as claimed in claim 1, wherein said solvent is selected from the group consisting of mineral oil, decalin, low molecular weight paraffin wax, and mixtures thereof.

18. The process as claimed in claim 1, wherein said dry yarn is maximally drawn in at least one stage until the last of such stages is at a draw ratio of less than or equal to about 1.2:1 to thereby form said partially oriented yarn.

19. The process as claimed in claim 1, wherein the partially oriented yarn having a tenacity of from about 12 to about 25 g/d.

20. The process as claimed in claim 1 wherein the product of the draw ratios DR1×DR2×DR3 is greater than or equal to about 10:1.

21. The process as claimed in claim 1 wherein the product of the draw ratios DR1×DR2×DR3 is greater than or equal to about 20:1.

* * * * *